US007238900B2

(12) United States Patent
Ulfik et al.

(10) Patent No.: US 7,238,900 B2
(45) Date of Patent: Jul. 3, 2007

(54) SWITCHING HINGE

(75) Inventors: Joachim Ulfik, Vlotho (DE); Markus Finger, Minden (DE); Lothar Pedron, Wenden (DE)

(73) Assignee: Bernstein AG, Westfalica (DE)

( * ) Notice: Subject to any disclaimer, the term of this patent is extended or adjusted under 35 U.S.C. 154(b) by 0 days.

(21) Appl. No.: 11/526,025

(22) Filed: Sep. 25, 2006

(65) Prior Publication Data

US 2007/0068778 A1 Mar. 29, 2007

(30) Foreign Application Priority Data

Sep. 26, 2005 (DE) ..... 10 2005 046 082

(51) Int. Cl.
*H01H 3/16* (2006.01)

(52) U.S. Cl. ..... 200/61.7; 200/61.62; 340/600; 340/545

(58) Field of Classification Search ..... 200/61.7, 200/61.69, 61.62, 61.76, 81.81–81.82; 340/545, 340/549, 556, 600
See application file for complete search history.

(56) References Cited

U.S. PATENT DOCUMENTS

| | | | | |
|---|---|---|---|---|
| 3,896,404 | A * | 7/1975 | Peterson | 335/205 |
| 4,140,357 | A * | 2/1979 | Wolz et al. | 439/31 |
| 4,284,861 | A * | 8/1981 | Senften | 200/61.7 |
| 5,717,380 | A * | 2/1998 | Zehrung | 340/545.7 |
| 5,870,787 | A * | 2/1999 | Choi | 8/159 |
| 6,191,938 | B1 * | 2/2001 | Ohgami et al. | 361/681 |
| 6,667,449 | B2 * | 12/2003 | Wecke et al. | 200/61.7 |

FOREIGN PATENT DOCUMENTS

| | | |
|---|---|---|
| DE | 10 2004 041 723 B3 | 4/2006 |
| GB | 2 150 757 A | 7/1985 |

* cited by examiner

*Primary Examiner*—Richard K. Lee
(74) *Attorney, Agent, or Firm*—Barnes & Thornburg LLP

(57) ABSTRACT

A switching hinge having a hinge housing at which a hinge flap is swivellably disposed about an axis. A switching element is coupled to the hinge flap, which switching element triggers a switching operation at a built-in switch in a predetermined position of the hinge flap.

12 Claims, 4 Drawing Sheets

SWITCHING HINGE

BACKGROUND AND SUMMARY

The present disclosure relates to a switching hinge having a hinge housing, at which a hinge flap is swivellably disposed about an axis. A switching element is coupled to the hinge flap, which switching element triggers a switching operation at a built-in switch in a predetermined position of the hinge flap.

Switching hinges exist where a hinge flap is swivellably disposed on a hinge housing and in which case, in a certain angular position, a switching element coupled with the hinge flap triggers a switching operation at a built-in switch. Once the switching point is defined, it can no longer be changed and should be protected from an access from the outside also under the aspect of safety with respect to manipulation. Here, it is a disadvantage that diverse equipment and safeguards have to be disassembled for transport purposes and adaptations to the existing localities have to take place during an installation. The known switching hinges cannot be adapted to such changed assembly positions.

From German Patent Document DE 10 2004 041 723, a hinge switch is known in the case of which a contact switch is provided between two hinge flaps swivellable relative to one another. The contact switch comprises a switching shaft which has a self-locking thread and can be rotated for adjusting the switching point.

British Patent Document GB 2 150 757 shows a hinge switch having two swivellably disposed hinge flaps. Here, switching elements are provided coaxially to a bolt connecting the hinge flaps, which switching elements have a first switching contact and a second switching contact. By rotating the switching contact by a transmission, the switching point can be adjusted.

The present disclosure relates to a switching hinge which can be adapted to different mounting situations and which permits a flexible defining of the switching point.

The present disclosure thus relates to a switching hinge comprising a hinge housing that includes a hinge flap swivellably disposed about an axis on the hinge housing. The switching hinge also includes a switching element coupled to the hinge flap along the axis, which switching element triggers a switching operation at a built-in switch in a predetermined position of the hinge flap. The built-in switch is adjustable to adjust a switching point at which the switching operation occurs. An exchangeable connection element is located between the switching element and the hinge flap. The exchangeable connection element is configured to transmit rotating motions between the switching element and the hinge flap. The exchangeable connection element is configured to be mounted either the hinge flap or the switching element in different angular positions to adjust the switching point on either the hinge flap or the switching element.

According to the present disclosure, the switching point of the built-in switch can be adjusted later, so that the switching hinge can be easily adapted to different installation situations. The adjusting devices for adjusting the switching point are arranged to be protected from an access from the outside, so that the switching hinge is secured with respect to manipulations. As a result, the switching hinge can be demounted and reused. Thus, adaptation to a respective installation situation is possible.

Furthermore, an exchangeable connection element for the transmission of rotating movements is provided between the switching element and the hinge flap, which connection element can be mounted on the hinge flap and/or on the switching element in different angular positions. The switching point of the switching hinge can thereby be newly defined in a simple manner, in which case only the connection element is exchanged or mounted in a different angular position in order to adjust the switching hinge to the desired switching point.

According to an embodiment of the present disclosure, the connection element can at least partially be fixed in a form-locking or force-locking manner on the hinge flap and/or the switching element, so that a continuous adjustment of the connection element becomes possible. If required, a new connection element can also be used for defining a new switching point.

The connection element may be constructed as a ring disk which is non-ratably coupled with the hinge flap and the switching element. As a result, the connection element can be produced in a cost-effective manner, and an adjustment of the switching point can then take place at low expenditures.

For a simple mounting, the connection element can be inserted into a receiving device constructed at the hinge flap, which receiving device has at least one inwardly protruding tooth. As a result, the inwardly protruding tooth can dig itself into the material of the connection element so that a non-rotatable connection is established. For this purpose, the connection element may be made of a plastically deformable material, such as a plastic material or of a soft metal.

In addition, the connection element may have an interior opening which has a shape deviating from the circular shape and can non-rotatably be connected with a protruding pin on the switching element. The opening may, for example, be constructed as a hexagon, so that a coupling can take place by a correspondingly constructed hexagonal pin.

For a compact construction, the switching element may be received in a protected manner in a switch housing in which the built-in switch is arranged. The built-in switch and the switching element may therefore be arranged securely with respect to a manipulation from the outside. In this case, the switch housing can be fixed on the hinge housing.

In order to be able to newly define a switching point in a simple manner, markings may be provided on the switch housing and the switching element, so that a corresponding orientation can be simplified.

Other aspects of the present disclosure will become apparent from the following descriptions when considered in conjunction with the accompanying drawings.

DETAILED DESCRIPTION

Figure 1:
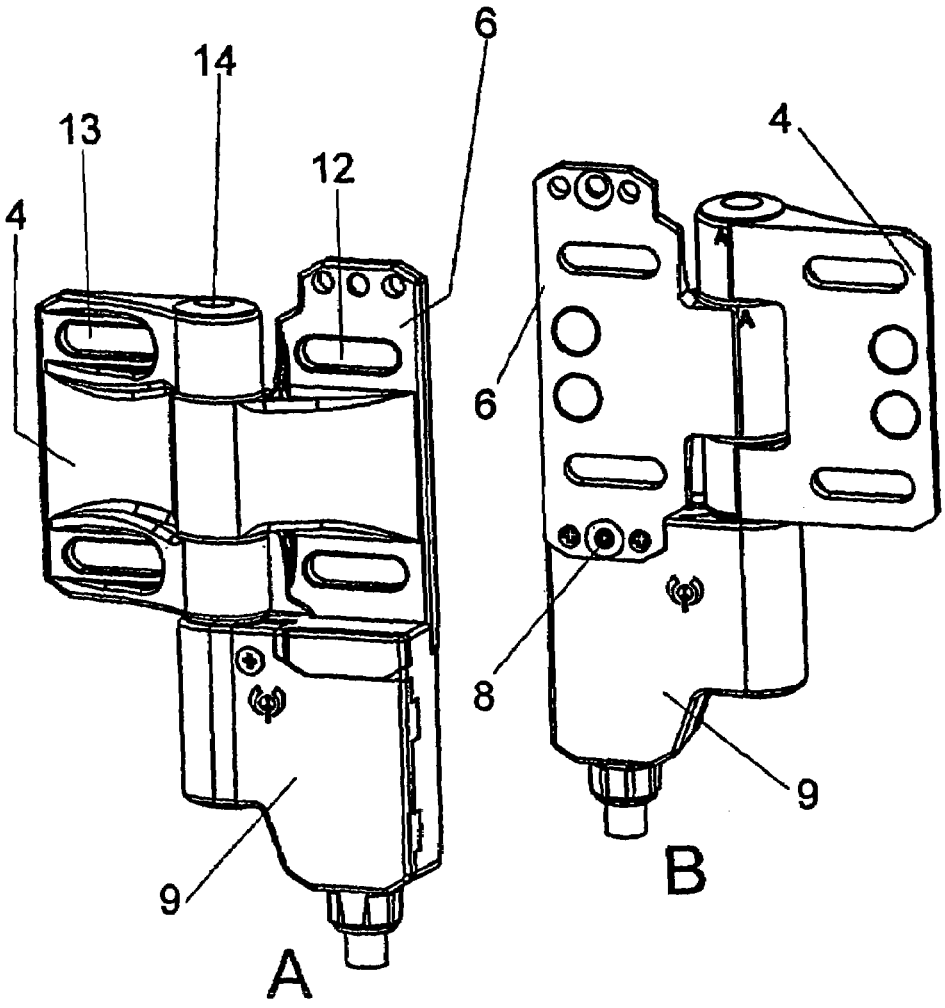
FIGS. 1A and 1B are two perspective views of a switching hinge according to the present disclosure.

A switching hinge comprises a hinge housing 6 on which a hinge flap 4 is rotatably fixed about an axis of rotation R. By at least one screw 8, a switch housing 9 is mounted to the hinge housing 6. In the switch housing 9 a built-in switch 7 is arranged which, in a certain angular position of the hinge flap 4 relative to the hinge housing 6, triggers a switching operation. The hinge housing 6 is provided with slots 12, whereby the hinge housing 6 can be mounted on a component (not shown). Slots 13 for a connection with another component (not shown) are provided on the hinge flap 4.

Figure 2:
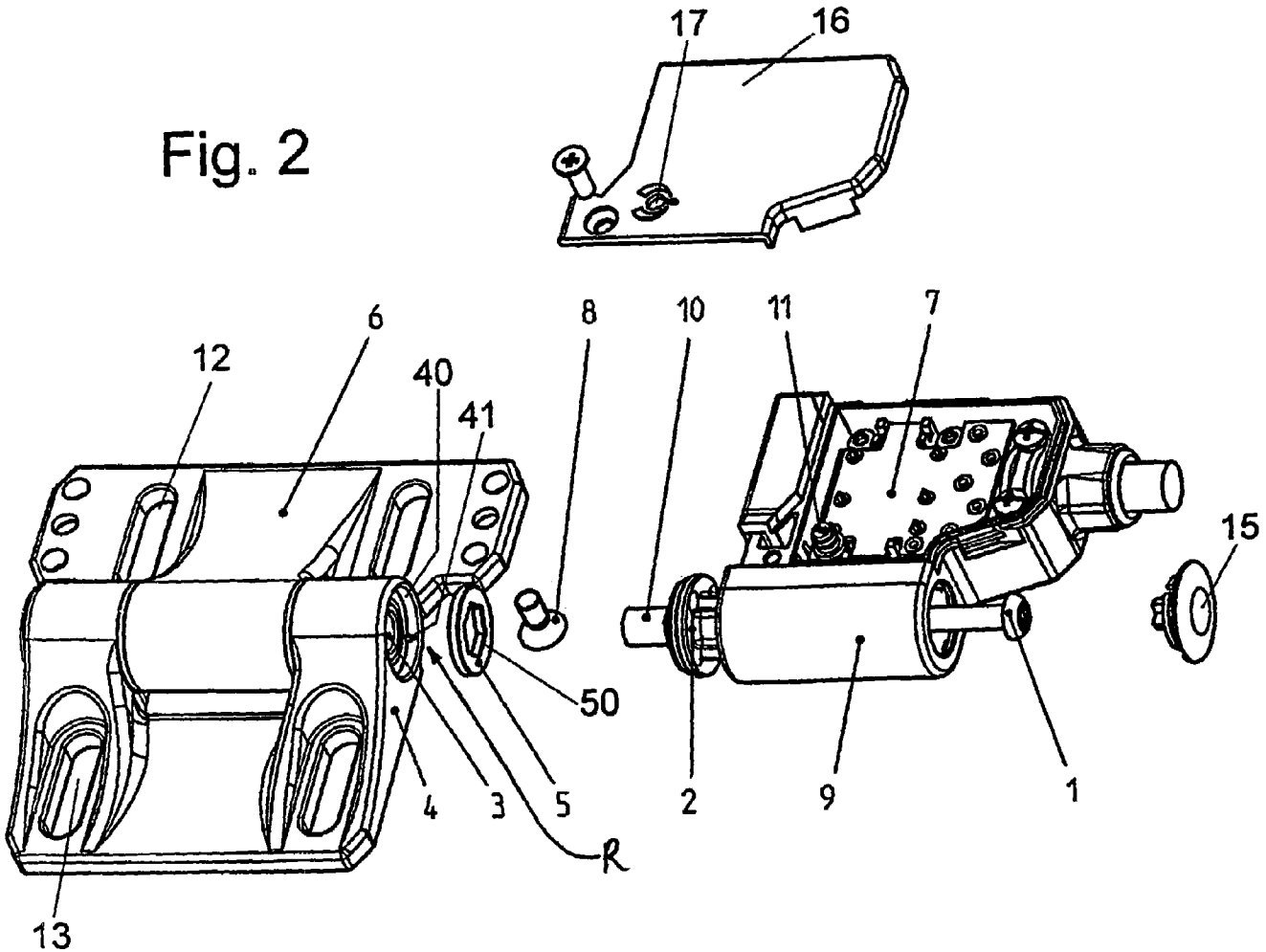
FIG. 2 is an exploded view of the switching hinge of FIGS. 1A and 1B.

As illustrated in FIG. 2, a screw 1 penetrates a switching element 2 in the form of a controller cylinder. The switching element 2 is inserted by a switching element guide 10 in the form of a cylindrical pin into a receiving device 3, which is arranged concentrically with respect to axis of rotation R of the hinge flap 4. The switching element 2 interacts with built-in switch 7 in order to trigger a switching operation at a certain angular position of the switching element 2.

For a non-rotatable coupling of the switching element 2 with the hinge flap 4, a connection element 5 in the form of a ring-shaped plastic disk is provided which has a circular outer circumference. The connection element 5 can be clampingly inserted into a receiving device 40 on the hinge flap 4. There is at least one tooth 41 protruding to the inside and projecting at the receiving device 40. The connection element 5 is form-lockingly pressed into the receiving device 40, so that a non-rotatable connection exists between the connection element 5 and the hinge flap 4. The tooth 41 may have different geometries. It may, for example, be constructed to be tapering, as a tongue for a groove and tongue connection, or as a projection, so that the receiving device 40 has a contour deviating from a circular shape. Several teeth 41 may be distributed along the circumference.

An opening 50 in the form of a hexagon is constructed in the connection element 5, into which opening 50 a corresponding hexagonal pin at the switching element 2 engages.

When the hinge flap 4 is swivelled together with a component, a relative movement takes place between the hinge flap 4 and the hinge housing 6. This rotating movement is transmitted by way of the connection element 5 and the switching element 2, until, in a certain angular position, a spring-loaded displaceable contact pin or key 18 acting at the switching element 2 engages in receiving device or recess in switching element 2 and in the process form-lockingly actuates electrical contacts. As a result, an electrical connection is opened or closed at the built-in switch 7. A particular position of the connection element 5 establishes a desired switching point at which a switching operation occurs.

When a user wants to define another desired switching point at the switching hinge, a covering cap 15 can first be removed from the switch housing 9 in order to release the screw 1. Then, the countersunk screw 8 is removed, so that the switch housing 9 can be swivelled and can be demounted from the hinge housing 6.

Figure 3:
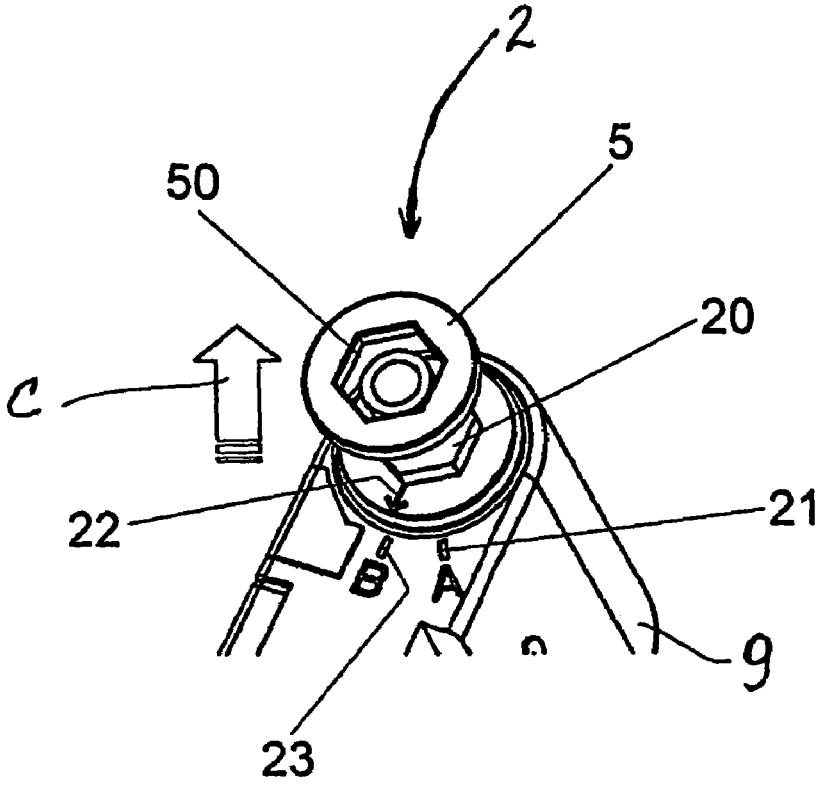
FIG. 3 is a perspective view of a switching element of a switching hinge, showing, for example, a defining of a new switching point, according to the present disclosure.

As suggested in FIG. 3, after the demounting of the switch housing 9, the connection element 5 can be pulled off (see arrow C) the switching element 2, so that a hexagonal pin 20 is removed from the corresponding hexagonal opening 50.

Subsequently, as suggested in FIG. 3, switching element 2 can be rotated until a marking 22 in the form of an arrow points to a marking 21, which is marked by an "A".

As suggested in FIG. 3, switching element 2 can now be pressed into the switch housing 9 to a stop and can then be rotated until the arrow 22 is swivelled to the marking 23, marked as a "B", at the switch housing 9.

Subsequently, as suggested in FIG. 3, a new connection element 5 may be fitted on the opening 50 and form-lockingly being placed on the hexagonal pin 20.

Then, the switch housing 9 is again inserted with the switching element guide 10 into the receiving device 3 of the hinge flap 4. Pins of the switch housing 9 are swivelled into bores of the hinge housing 6 and the switch housing 9 is fixed at the hinge housing 6 by countersunk screw 8.

As shown in FIGS. 4A and 4B, it is possible to carry out a precision adjustment after a rough adjustment of the desired switching point has taken place. An adjusting screw 11 is provided in the switch housing 9, which adjusting screw 11 is accessible from a top side as well as from a bottom side of the switch housing 9 by way of an opening 17. The built-in switch 7 can be swivelled by adjusting screw 11 (see arrows 110) and by a pivot 19, as illustrated by two arrows 70. Pivot 19 may be constructed as a film hinge integrally with the switch housing 9.

By the swivelling motion of the built-in switch 7, spring-loaded key 18 is moved slightly from a center position in an upward or downward direction, so that its position is changed relative to the switching element 2. A recess is provided on an outer circumference of the switching element 2, into which recess the spring-loaded key 18 engages for triggering a switching operation. Thus, in a certain area, the position of the key 18 can thereby be changed by the adjusting screw 11, so that the switching point is changed, which results from the interaction of the key 18 and the switching element 2.

In an embodiment of the present disclosure, the connection element 5 is exchangeably fixed in a receiving device 40 of the hinge flap 4. It is conceivable to provide a projecting pin, for example, tooth 41 on the hinge flap 4 and to construct the receiving device 40 at the switching element 2. Furthermore, other fastening devices may also be provided in order to achieve a non-rotatable connection between the switching element 2 and the hinge flap 4.

One or more contacts may be provided at the switching element 2 in order to be able to utilize a corresponding number of desired switching points. In addition, it is conceivable to provide electronic or magnetic sensors at the switching element 2 by which a detection of the angular position of the hinge flap 4 becomes possible.

The connection element 5 provides a mechanical coupling of the hinge flap 4 and the switching element 2. It is conceivable to provide different devices for transmitting the rotating motion, such as magnets or other non-contact connection elements.

The built-in switch 7 is accommodated in a switch housing 9 which is fixed on the hinge housing 6. However, it is conceivable to arrange the built-in switch 7 in a modification of hinge housing 6 in order to implement a particularly compact construction so that the switch housing 9 can be eliminated.

Although the present disclosure has been described and illustrated in detail, it is to be clearly understood that this is done by way of illustration and example only and is not to be taken by way of limitation. The scope of the present disclosure is to be limited only by the terms of the appended claims.

Switching Hinge

The present invention relates to a switching hinge having a hinge housing, at which a hinge flap is swivellably disposed about an axis, a switching element coupled to the hinge flap being provided on the axis, which switching element triggers a switching operation at a built-in switch in a predetermined position of the hinge flap.

Switching hinges exist where a hinge flap is swivellably disposed on a hinge housing and in which case, in a certain angular position, a switching element coupled with the hinge flap triggers a switching operation at a built-in switch. Once the switching point is defined, it can no longer be changed and should be protected from an access from the outside also under the aspect of safety with respect to manipulation. Here, it is a disadvantage that diverse equipment and safeguards have to be disassembled for transport purposes and adaptations to the existing localities have to take place during an installation. The known switching hinges cannot be adapted to such changed assembly positions.

From German Patent Document DE 10 2004 041 723, which is a later publication, a hinge switch is known in the case of which a contact switch is provided between two hinge flaps swivellable relative to one another. The contact switch comprises a switching shaft which has a self-locking thread and can be rotated for adjusting the switching point.

British Patent Document GB 2 150 757 shows a hinge switch having two swivellably disposed hinge flaps. Here, switching elements are provided coaxially to a bolt connecting the hinge flaps, which switching elements have a first switching contact and a second switching contact. By rotating the switching contact by means of a transmission, the switching point can be adjusted.

It is therefore an object of the present invention to create a switching hinge which can be adapted to different mounting situations and which permits a flexible defining of the switching point.

This object is achieved by means of a switching hinge having the characteristics of Claim 1.

According to the invention, the switching point of the built-in switch can be adjusted later, so that the switching hinge can be easily adapted to different installation situations. The adjusting devices for adjusting the switching point are preferably arranged to be protected from an access from the outside, so that the switching hinge is secured with respect to manipulations. As a result, the switching hinge can be demounted and reused, an adaptation to the respective installation situation being made possible.

Furthermore, an exchangeable connection element for the transmission of rotating movements is provided between the switching element and the hinge flap, which connection element can be mounted on the hinge flap and/or on the switching element in different angular positions. The switching point of the switching hinge can thereby be newly defined in a simple manner, in which case only the connection element is exchanged or mounted in a different angular position in order to adjust the switching hinge to the desired switching point.

According to a preferred embodiment of the invention, the connection element can at least partially be fixed in a form-locking or force-locking manner on the hinge flap and/or the switching element, so that a continuous adjustment of the connection element becomes possible. If required, a new connection element can also be used for defining a new switching point.

The connection element is preferably constructed as a ring disk which is non-ratably coupled with the hinge flap and the switching element. As a result, the connection element can be produced in a cost-effective manner, and an adjustment of the switching point then take place at low expenditures.

For a simple mounting, the connection element can be inserted into a receiving device constructed at the hinge flap, which receiving device has at least one inwardly protruding tooth. As a result, the inwardly protruding tooth can dig itself into the material of the connection element so that a non-rotatable connection is established. For this purpose, the connection element may be made of a plastically deformable material, preferably of a plastic material or of a soft metal.

In addition, the connection element may have an interior opening which has a shape deviating from the circular shape and can non-rotatably be connected with a protruding pin on the switching element. The opening may, for example, be constructed as a hexagon, so that a coupling can take place by means of a correspondingly constructed hexagonal pin.

For a compact construction, the switching element is received in a protected manner in a switch housing in which the built-in switch is arranged. The built-in switch and the switching element are therefore arranged securely with respect to a manipulation from the outside. In this case, the switch housing can be fixed on the hinge housing.

In order to be able to newly define a switching point in a simple manner, markings are preferably provided on the switch housing and the switching element, so that a corresponding orientation is simplified.

The invention will be explained in detail in the following by means of an embodiment with respect to the attached drawings.

FIGS. 1A and 1B are two perspective views of a switching hinge according to the invention;

FIG. 2 is an exploded view of the switching hinge of FIG. 1;

FIG. 3 is a perspective view of the switching element of the switching hinge when defining a new switching point; and FIGS. 4A and 4B are two views of the switch housing of the switching hinge of FIG. 1.

A switching hinge comprises a hinge housing 6 on which a hinge flap 4 is rotatably fixed. By means of at least one screw 8, a switch housing 9 is mounted on the hinge housing 6, in which switch housing 9 a built-in switch is arranged which, in a certain angular position of the hinge flap 4 relative to the hinge housing 6, triggers a switching operation. In this case, the hinge housing 6 is provided with slots 12, whereby the hinge housing 6 can be mounted on a component, slots 13 for the connection with another component also being provided on the hinge flap 4.

As illustrated in FIG. 2, a screw 1 penetrates a switching element 2 in the form of a controller cylinder. The switching element 2 is inserted by means of a switching element guide 10 in the form of a cylindrical pin into a receiving device 3, which is arranged concentrically with respect to the axis of rotation of the hinge flap 4. The switching element 2 interacts with a built-in switch in order to trigger a switching operation in the case of a certain angular position of the switching element 2.

For a non-rotatable coupling of the switching element 2 with the hinge flap 4, a connection element 5 in the form of a ring-shaped plastic disk is provided which has a circular outer circumference. The connection element 5 can be clampingly inserted into a receiving device 40 on the hinge flap 4, at least one tooth 41 protruding to the inside projecting at the receiving device 40. The connection element 5 is form-lockingly pressed into the receiving device 40, so that a non-rotatable connection exists between the connection element 5 and the hinge flap 4. In this case, the tooth 41 may have different geometries. It may, for example, be constructed to be tapering, as a tongue for a groove and tongue connection, or as a projection, so that the receiving devices ha a contour deviating from a circular shape. In this case, several teeth 41 distributed along the circumference may also be provided.

An opening in the form of a hexagon is constructed in the connection element 5, into which opening a corresponding hexagonal pin at the switching element 2 engages.

When the hinge flap 4 is now swivelled together with a component, a relative movement takes place between the hinge flap 4 and the hinge housing 6, the rotating movement being transmitted by way of the connection element 5 and the switching element 2, until, in a certain angular position, a spring-loaded displaceable contact pin acting at the switching element 2 engages in a receiving device and in the process form-lockingly actuates electrical contacts. As a result, an electrical connection is opened or closed at the built-in switch 7.

When the user wants to define another switching point at the switching hinge, a covering cap 15 can first be removed from the switch housing 9 in order to release the screw 1. Then, the countersunk screw 8 is removed, so that the switch housing can be swivelled and can be demounted from the hinge housing 6.

As illustrated in FIG. 3A, after the demounting of the switch housing 9, the connection element 5 can be pulled off the switching element 2, so that the hexagonal pin 20 is removed from the corresponding hexagonal opening 50.

Subsequently, corresponding to FIG. 3B, the switching element 2 is rotated until a marking 22 in the form of an arrow points to a marking 21 which is marked by an "A".

Corresponding to FIG. 3C, the switching element 2 must now be pressed into the switch housing 9 to the stop and must then be rotated until the arrow 22 is swivelled to the marking 23 at the switch housing 9.

Subsequently, according to FIG. 3D, a new connection element 5 is fitted on, the opening 50 form-lockingly being placed on the hexagon 20.

Then, the switch housing 9 is again inserted with the switching element guide 10 into the receiving device 3 of the hinge flap 4. In this case, the pins of the switch housing 9 are swivelled into the bores of the hinge housing 6 and the switch housing 9 is fixed at the hinge housing 6 by way of the countersunk screw 8.

Figure 4:
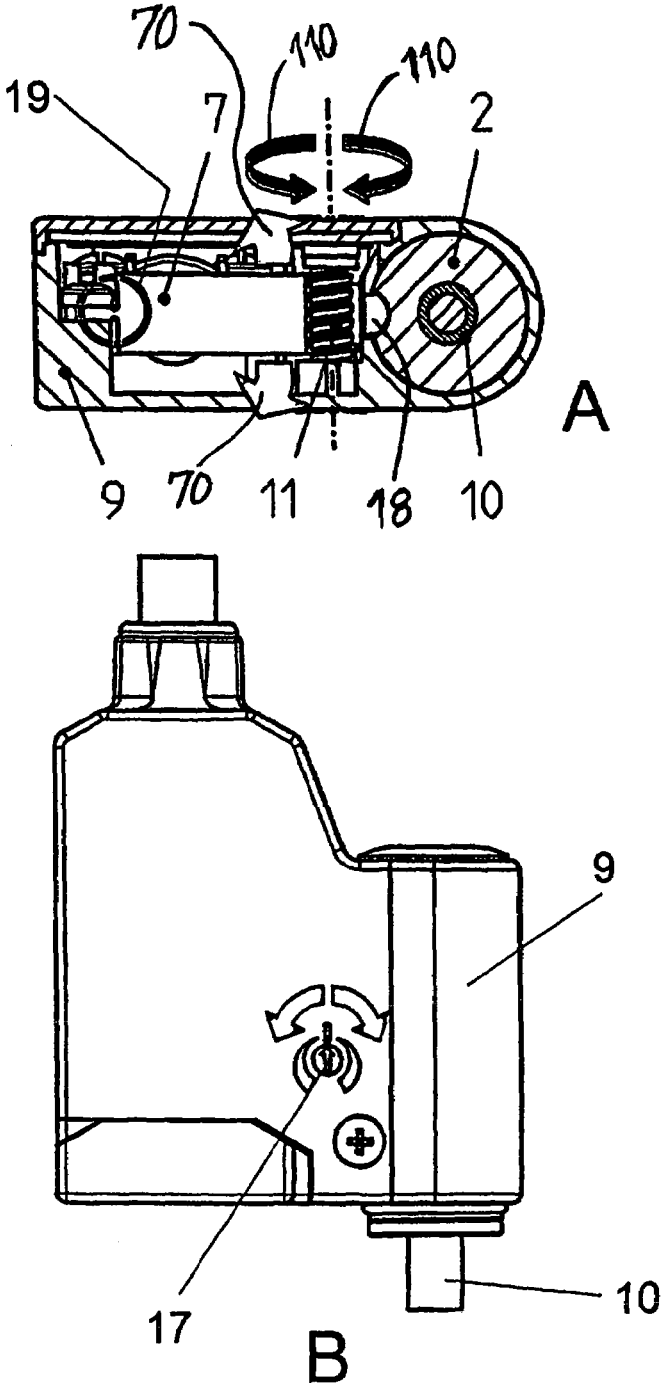
FIG. 4A is top, partial cross-sectional view of the switch housing of the switching hinge of FIGS. 1A and 1B
FIG. 4B is a side view of the switch housing of the switching hinge of FIGS. 1A and 1B.

In order to be able to carry out a precision adjustment after a rough adjustment of the switching point, the switch housing 9 is shown in FIG. 4 as a sectional view. An adjusting screw 11 is provided in the switch housing 9, which adjusting screw 11 is accessible from the top side as well as from the bottom side of the switch housing 9 by way of a respective opening 17. The built-in switch 7 can be swivelled by way of the adjusting screw 11 by means of a pivot 19, as illustrated schematically by means of the two arrows. In this case, it is conceivable to construct the pivot 19 as a film hinge which is constructed integrally with the switch housing 9.

By means of the swivelling motion of the built-in switch 7, a spring-loaded key 18 is moved slightly from the center position in the upward or downward direction, so that its position is changed relative to the switching element 2. A recess is provided on the outer circumference of the switching element 2, into which recess the spring-loaded key 18 engages for triggering a switching operation. Thus, in a certain area, the position of the key 18 can thereby be changed by the adjusting screw 11, so that the switching point is changed which results from the interaction of the key 18 and the switching element 2.

In the illustrated embodiment, the connection element 5 is exchangeably fixed in a receiving device of the hinge flap 4. It is naturally also conceivable to provide a projecting pin on the hinge flap and to construct the receiving device at the switching element 2. Furthermore, other fastening devices may also be provided in order to achieve a non-rotatable connection between the switching element 2 and the hinge flap 4.

One or more contacts may be provided at the switching element 2 in order to be able to utilize a corresponding number of switching points. In addition, it is conceivable to provide electronic or magnetic sensors at the switching element by means of which the detection of the angular position of the hinge flap 4 becomes possible.

In the illustrated embodiment, the connection element 5 provides a mechanical coupling of the hinge flap and the switching element 2. It is also conceivable to provide different devices for transmitting the rotating motion, such as magnets or other non-contact connection elements.

In the illustrated embodiment, the built-in switch 7 is accommodated in a switch housing 9 which is fixed on the hinge housing 6. However, it is also conceivable to arrange the built-in switch 7 in a modified hinge housing 6 in order to implement a particularly compact construction so that the switch housing 9 can be eliminated.

The invention claimed is:

1. A switching hinge, comprising:

a hinge housing including a hinge flap swivellably disposed about an axis on the hinge housing;

a switching element coupled to the hinge flap along the axis, which switching element triggers a switching operation at a built-in switch in a predetermined position of the hinge flap;

the built-in switch being adjustable to adjust a switching point at which the switching operation occurs;

an exchangeable connection element located between the switching element and the hinge flap, the exchangeable connection element configured to transmit rotating motions between the switching element and the hinge flap; and the exchangeable connection element being configured to be mounted on one of the hinge flap and the switching element in different angular positions to adjust the switching point on one of the hinge flap and the switching element.

2. The switching hinge according to claim 1, wherein the connection element is fixed at least partially form-lockingly and force-lockingly on one of the hinge flap and the switching element.

3. The switching hinge according to claim 1, wherein the connection element is constructed as a ring disk which is non-rotatably coupled with the hinge flap and the switching element.

4. The switching hinge according to claim 1, wherein the connection element is inserted into a receiving device which is constructed on the hinge flap and has at least one inward-projecting tooth.

5. The switching hinge according to claim 1, wherein the connection element includes an interior opening which has a shape deviating from a circular shape and which is non-rotatably connected with a projecting pin on the switching element.

6. The switching hinge according to claim 1, wherein the connection element is constructed of a plastically deformable material.

7. The switching hinge according to claim 1, wherein the switching element is accommodated in a protected manner in a switch housing in which the built-in switch is arranged.

8. The switching hinge according to claim 7, wherein, to define a switching point, markings are provided on the switch housing and the switching element.

9. The switching hinge according to claim 7, wherein the switch housing is fixed on the hinge housing.

10. The switching hinge according to claim 9, wherein sensors to detect the angular position are provided on the switching element.

11. The switching hinge according to claim 1, wherein the built-in switch is integrated in the hinge housing.

12. The switching hinge according to claim 1, wherein several contacts are provided to permit different switching points and, by a rotating motion of the hinge flap, the different switching points are triggered in a respective angular position.

* * * * *